United States Patent [19]

Vosper

[11] 4,306,710

[45] Dec. 22, 1981

[54] BAR TYPE JACK HAVING JAW EXTENSIONS REMOVABLY ATTACHED THERETO

[76] Inventor: George W. Vosper, 149 Earl St., Kingston, Canada, K7L 2H3

[21] Appl. No.: 182,028

[22] Filed: Aug. 28, 1980

[51] Int. Cl.[3] ..... B25B 1/10

[52] U.S. Cl. ..... 269/88; 269/204; 269/252; 269/283

[58] Field of Search ..... 269/203-204, 269/277, 283, 88, 250-252, 246, 166-170; 29/239

[56] References Cited

U.S. PATENT DOCUMENTS

| | | | |
|---|---|---|---|
| 612,415 | 10/1898 | Hanson | 269/283 X |
| 800,685 | 10/1905 | Scoggins | 269/283 X |
| 2,221,325 | 11/1940 | Holman | 269/167 |
| 2,815,778 | 12/1957 | Holman | 269/170 |
| 3,061,302 | 10/1962 | Dennis | 269/88 X |
| 3,499,206 | 3/1970 | Quernheim | 269/283 X |
| 3,662,994 | 5/1972 | Johns | 29/239 X |
| 3,933,346 | 1/1976 | Carver | 269/88 X |
| 4,257,584 | 3/1981 | Sterling | 269/88 |

*Primary Examiner*—Robert C. Watson

*Attorney, Agent, or Firm*—Stanley E. Johnson; Richard J. Hicks

[57] ABSTRACT

A bar type jack having first and second pipes of suitable length each threaded at at least one end thereof. The first pipe is substantially longer than the second pipe and has a first jaw member slidable therealong for quick positioning and lockable at any position. A mounting bracket having a threaded bore extending from one face thereof to and through an opposite face interconnects the first and second pipes. A second jaw member is slidable along the second pipe and movable by rotating a threaded rod that extends through an additional threaded bore in the bracket. A handle is swingably connected to one end of the threaded rod for use in rotating the rod. Removable jaw attachments are provided and so shaped as to permit jacking one member relative to another when the members to be jacked apart are located closely adjacent one another.

3 Claims, 3 Drawing Figures

BAR TYPE JACK HAVING JAW EXTENSIONS REMOVABLY ATTACHED THERETO

This invention relates to a jack devised from modifications to a bar clamp in combination with removable jaw attachments permitting jacking one member relative to another which are closely adjacent one another.

Bar clamps are well known and extensively used for a variety of purposes. They consist basically of a rod or pipe having two jaw members mounted thereon, one of which is freely slidable providing quick adjustment and lockable at any position, and the other movable by a rotatable threaded screw for slow adjustment and providing suitable leverage for clamping articles disposed between the jaw members. The known bar clamps, however, are usable only to clamp an article between the jaw members.

Disclosed in applicant's U.S. application Ser. No. 060,487 filed July 25th, 1979 are modifications to a standard bar clamp permitting the same to be used as a jack. The jack comprises a first pipe threaded at one end thereof; a first jaw member slidable longitudinally along the first pipe for quick positioning and having means to lock the same at any position therealong; a mounting bracket having first and second threaded bores extending therethrough parallel to and spaced apart from one another; a second pipe threaded at one end thereof, said first and second pipes being threaded into said first threaded bore respectively from opposite ends thereof; a second jaw member slidable along said second pipe; a threaded rod extending through said second threaded bore in the bracket and rotatably connected to said second jaw member to move the same during rotation of the threaded rod, said threaded rod being axially parallel with said pipes; and handle means swingingly connected at one end thereof to one end of said threaded rod for rotating the same, said first and second jaw members each having an article engaging face and wherein said faces are directed away from one another.

Because of this latter feature and the arrangement of parts including the location of the handle (i.e. between the jaw members) there is a minimum spacing between the jaws at which the device can be used as a jack. Elements to be jacked apart, however, for example floor boards, are often closely adjacent one another and the spacing therebetween is less than said minimum spacing. To overcome this difficulty there is provided in accordance with the present invention removable jaw attachments having further article engaging faces wherein such further article engaging faces (facing away from one another) are closely adjacent one another at said minimum spacing of the jaws.

The invention is illustrated by way of example in the accompanying drawings wherein.

Figure 1:
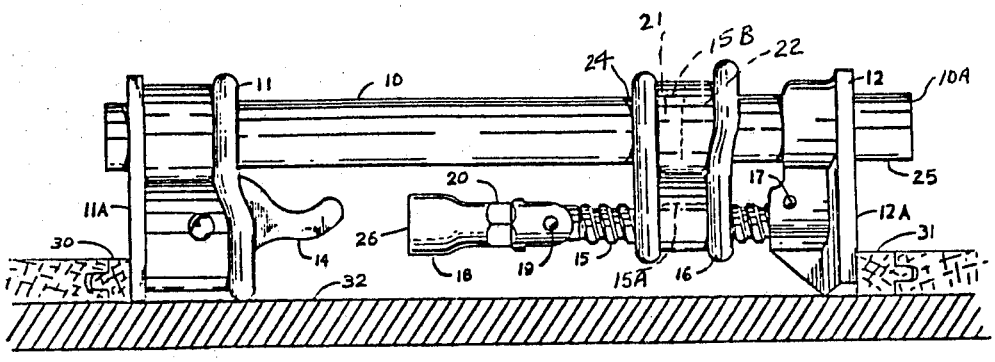
FIG. 1 is an elevational view of the bar jack.

Referring to the drawings, there is illustrated a bar type jack consisting of pipes 10 and 10A having first and second respective jaw members 11 and 12 movable therealong. Jaw members 11 and 12 have respective article engaging faces 11A and 12A facing away from one another and each jaw member 11 and 12 has an aperture 13 appropriately sized to provide a sliding fit on the respective pipes. Jaw member 11 is freely slidable along the pipe 10 and lockable at any position longitudinally therealong in a conventional manner by a spring loaded eccentric means 14. The construction of the jaw member 11 including the eccentric is conventional and thus need not be shown or described in detail herein.

Jaw member 12 is movable longitudinally along pipe 10A by a rotatable threaded rod 15 anchored to the pipe 10 by a bracket 16. The threaded rod 15 is rotatably attached to the jaw member 12 by a pin 17 in a conventional manner and passes through a first threaded bore 15A in the bracket. The threaded rod 15 is rotated by a handle 18 pivotally connected at one end to the threaded rod by a pin 19. The handle has flats thereon, (i.e. hexagonal, squared, or otherwise cross-sectionally shaped) as indicated at 20 to permit utilizing a wrench for rotating the screw when the handle is in axial or approximately axial alignment with the threaded rod. The outer end of the handle has a squared recess for use in association with a ratchet handle of a socket wrench set.

The bracket 16 has a second threaded bore 15B extending therethrough parallel to and spaced from the threaded bore 15A. The threaded bore 15B may be a straight through standard pipe thread but preferably is tapered having respective first and second tapered threaded portions 21 and 22 tapped on a common centreline from opposite faces of the bracket.

Pipe 10 has a threaded end 24 (a standard pipe thread) threaded into threaded portion 21 of the bracket and pipe 10A, threaded at one end thereof, is threaded into the threaded portion 22. The pipe 10A provides a guide for a jaw member 12 of the jack. The threaded portions 21 and 22 in the bracket are axially aligned and thus pipe 10A is effectively an extension to pipe 10. The length of pipe 10A is relatively short compared to pipe 10 and is only slightly longer than the travel of the threaded rod 15 in the bracket. Since the article engaging faces 11A and 12A of the respective jaw members face away from one another it is necessary to move one jaw in a direction away from the other to apply a force via the jaw faces. Thus, when jaw face 11A is in engagement with one object and jaw face 12A in engagement with another object movement of jaw member 12 rotation of threaded rod 15 causes a pushing force tending to separate the objects. Applicant's device may, for example, be used to place floor boards on a sub-floor and such use is illustrated in FIG. 1.

As seen in FIG. 1, jaw face 11A is in engagement with a tongue and groove hardwood flooring board 30 and the other jaw face 12A is in engagement with a similar board 31 being placed on a sub-floor 32. Appropriate rotation of the threaded rod 15 results in jacking boards 30 and/or 31 into tight fitting engagement with the previously placed flooring boards. In such application of the device, and as apparent from FIG. 1, there is little space between the pipe 10 and the sub-floor for the handle. For this reason the handle is swingably connected to the threaded rod and while only one pivot pin is shown in such connection obviously two pivot pins arranged at right angles to one another may be used providing a universal joint.

Figure 2:
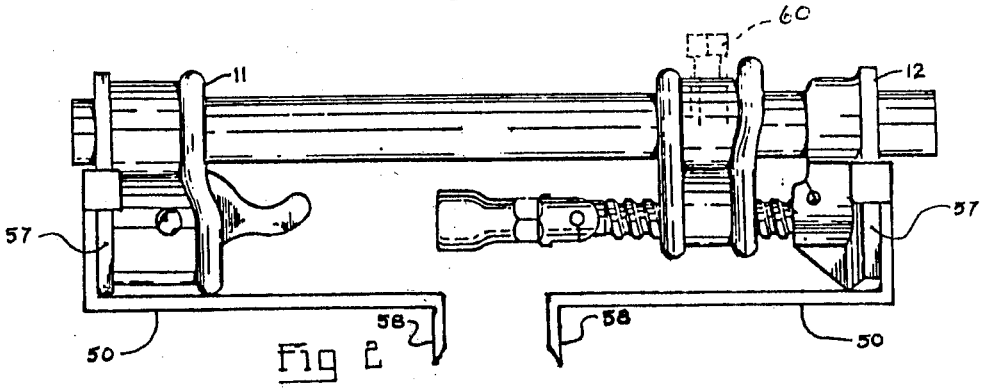
FIG. 2 is a view similar to FIG. 1 but including removable jaw attachments provided in accordance with the present invention.
Figure 3:
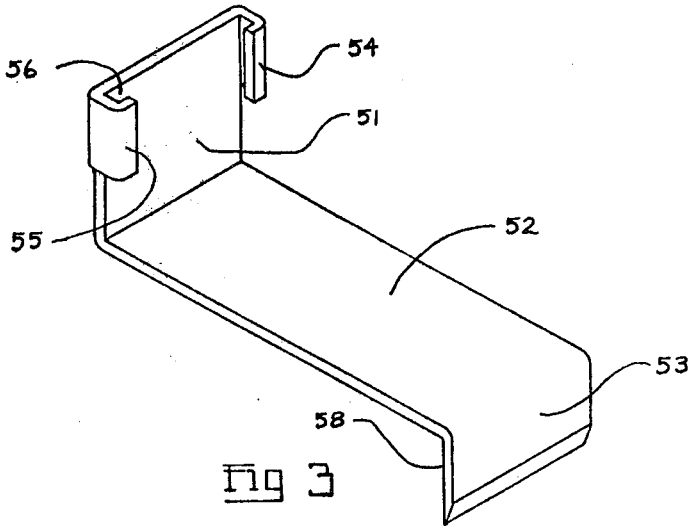
FIG. 3 is an enlarged oblique view of the jaw attachment.

In accordance with the present invention removable jaw attachments are provided that have secondary article engaging faces permitting jacking apart members that are located closely adjacent one another. Referring to FIG. 2 there is illustrated applicant's bar type jack having a jaw extension member 50 removably attached to the respective jaw members 11 and 12. The pair of extension members are identical and thus only one will be described. Referring to FIG. 3, member 50 consists of a jaw mounting portion 51, a leg portion 52 and a flange 53. The mounting portion 51 and flange 53 are located respectively at opposite ends of the leg portion 52 and are each disposed substantially at right angles thereto, one projecting from the leg in one direction and the other in an opposite direction. The jaw mounting portion has a pair of lugs 54 and 55 projecting inwardly toward one another providing a channel 56 that slidably fits onto end flanges 57 of the jaw members 11 and 12. Flange 53 has a secondary article engaging face 58 and it is obvious from FIG. 2 such article engaging faces permit jacking apart members that are closely adjacent one another.

As described in the foregoing, pipes 10 and 10A respectively are threaded into a threaded bore in bracket member 16. The bracket is thus fixedly secured to the pipes and only jaw 11 is freely slidable and lockable at any position along the pipe 10. If desired, however, pipe 10 and pipe 10A may be a single length of pipe with the bracket member 16 slidable therealong and lockable at any position by an eccentric cam of the same type as used with respect to jaw member 11. In such an arrangement the single length member may be either a pipe or a bar on which both the jaw member 11 and bracket 16 are freely slidable and lockable at any position longitudinally along the length of the member. Alternatively, bracket 16 can be anchored to the pipe at any position by a set screw 60 shown in broken line in FIG. 2.

I claim:

1. A jack comprising:

(a) a first pipe threaded at one end thereof;

(b) a first jaw member slidable longitudinally along said first pipe for quick positioning and having means to lock the same at any position therealong;

(c) a mounting bracket having first and second threaded bores extending therethrough parallel to and spaced apart from one another;

(d) a second pipe threaded at one end thereof, said first and second pipes being threaded into said first threaded bore respectively from opposite ends thereof;

(e) a second jaw member slidable along said second pipe;

(f) a threaded rod extending through said second threaded bore in the bracket and rotatably connected to said second jaw member to move the same during rotation of the threaded rod, said threaded rod being axially parallel with said pipes;

(g) handle means swingingly connected at one end thereof to one end of said threaded rod for rotating the same, said swingable handle permitting turning said threaded rod avoiding interference from said first pipe, said first and second jaw member each having an article engaging face and wherein said faces are directed away from one another with some selected minimum spacing therebetween; and (h) a Z-shaped jaw extension member slidably mountable onto and removable from each of respective ones of said first and second jaw members, said extension members having further article engaging faces directed away from one another with the spacing therebetween being substantially less than said minimum spacing.

2. A jack as defined in claim 1 wherein said jaw extension members each comprise an elongate bar defining a leg having a jaw mounting flange portion at one end thereof and article engaging flange portion at the opposite end thereof, said flange portions projecting from a leg respectively in opposite directions and approximately at right angles to the leg.

3. A jack comprising:

(a) a longitudinally extending rigid member;

(b) a first jaw member and a bracket member, each freely slidable longitudinally along said rigid member for quick positioning, each of said first jaw member and bracket member having means cooperating with said rigid member to lock the respective members at any position along the rigid member;

(c) a second jaw member slidable along said rigid member;

(d) a threaded rod extending through said bracket and rotatably connected to said second jaw member to move the same during rotation of the threaded rod, said threaded rod being axially parallel with said rigid member;

(e) handle means swingingly connected at one end thereof to one end of said threaded rod for rotating the same, said swingable connection permitting rotating the threaded rod avoiding interference with said rigid member, said first and second jaw member each having an article engaging face and wherein said faces are directed away from one another with some selected minimum spacing therebetween; and (f) a Z-shaped jaw extension member removably slidably mounted on each of respective ones of said first and second jaw members, said extension members having further article engaging faces directed away from one another with the spacing therebetween being substantially less than said minimum spacing.

* * * * *